United States Patent [19]

Adomis, Jr. et al.

[11] Patent Number: 4,519,300

[45] Date of Patent: May 28, 1985

[54] FILLED PISTON WITH CENTRAL OIL TUBE

[75] Inventors: Peter P. Adomis, Jr., Dover; Millard J. Martin, York, both of Pa.

[73] Assignee: Caterpillar Tractor Co., Peoria, Ill.

[21] Appl. No.: 624,501

[22] PCT Filed: Apr. 5, 1982

[86] PCT No.: PCT/US82/00433

§ 371 Date: Apr. 5, 1982

§ 102(e) Date: Apr. 5, 1982

[87] PCT Pub. No.: WO83/03650

PCT Pub. Date: Oct. 27, 1983

[51] Int. Cl.[3] ..... F16J 1/08

[52] U.S. Cl. ..... 92/158; 91/488; 92/248

[58] Field of Search ..... 92/158, 248, 172, 212, 92/249, 255; 91/499, 488; 29/156.5 R

[56] References Cited

U.S. PATENT DOCUMENTS

| | | | |
|---|---|---|---|
| 3,319,575 | 5/1967 | Havens | 92/255 X |
| 3,574,293 | 4/1971 | Vriend | 92/249 X |
| 3,633,467 | 1/1972 | Watanabe | 92/172 |
| 3,707,113 | 12/1972 | Hein et al. | 92/248 |
| 3,984,904 | 10/1976 | Schlecht | 29/156.5 R |
| 4,216,704 | 8/1980 | Heyl | 92/78 |

FOREIGN PATENT DOCUMENTS

| | | | |
|---|---|---|---|
| 2653867 | 6/1978 | Fed. Rep. of Germany | 92/158 |
| 47-37843 | 9/1972 | Japan | 91/488 |
| 855582 | 12/1960 | United Kingdom | 91/488 |

*Primary Examiner*—Irwin C. Cohen

*Attorney, Agent, or Firm*—John W. Grant

[57] ABSTRACT

A filled piston (10) has a tube (19) extending axially through the core (13) of filler material. The tube (19) provides the passage (23) through which hydraulic fluid passes to lubricate the bearing surfaces of components associated with the piston (10). This eliminates the problem of the hydraulic fluid eroding the filler material and thus the need for visual inspection of the passage through the piston.

4 Claims, 2 Drawing Figures

FILLED PISTON WITH CENTRAL OIL TUBE

TECHNICAL FIELD

This invention relates generally to a filled piston for use in fluid pumps and motors and more particularly to a filled piston having a centrally disposed tube therein.

BACKGROUND ART

Conventionally the pistons employed in axial piston pumps and motors are hollow and contain a lightweight filler material to reduce the high inertia forces acting on the piston during operation of the pumps and motors. A passage normally extends through the filler material and through the base portion of the piston to transmit hydraulic fluid through the piston to lubricate the bearing surfaces of the components associated with the piston. Examples of such filled pistons are described in U.S. Pat. No. 3,984,904 which issued to Charles H. Schlecht on Oct. 12, 1976, U.S. Pat. No. 3,707,113 which issued to Hein et al on Dec. 26, 1972 and U.S. Pat. No. 3,633,467 which issued to Watanabe et al on Jan. 11, 1972.

One of the problems encountered with such filled pistons is the formation of cracks or cavities in the passage in the filler material during the manufacturing process. It has been found that the high pressure hydraulic fluid passing through the passage tends to erode the crack or cavity. Such eroded material is then carried into the bearing surfaces associated with the piston thereby damaging the bearing surfaces. In some cases, the eroded material blocks the passage in the base portion of the piston and thereby blocks the flow of lubricating fluid to the bearing surfaces which again causes damage to the bearing surfaces.

Because of the above problem, it is necessary to visually inspect the passage in every piston with a cystoscope type instrument to insure that there are no cracks or cavities in the passage. Such 100% inspection adds to the manufacturing time and thus increases the total cost of manufacturing the piston. Moreover because of the stringent requirements that the fluid passage not have any visible cracks therein, approximately 40% of the filled pistons are scrapped.

The present invention is directed to overcoming one or more of the problems as set forth above.

DISCLOSURE OF THE INVENTION

In one aspect of the present invention a piston having a base portion, a hollow skirt portion, and a core of lightweight filler material situated within the skirt portion includes a tube extending axially through the core of filler material and having an inner end portion connected to the base portion, and means for interlocking the tube and the core of filler material.

The problem of assuring that no cracks or cavities exist in the passage in the filler material is solved by utilizing a tube extending axially through the core of filler material. Since the passage for transmitting the lubricating fluid through the piston to the bearing surfaces is formed by the tube itself, it is not necessary to visually inspect the passage.

BEST MODE FOR CARRYING OUT THE INVENTION

Figure 1:
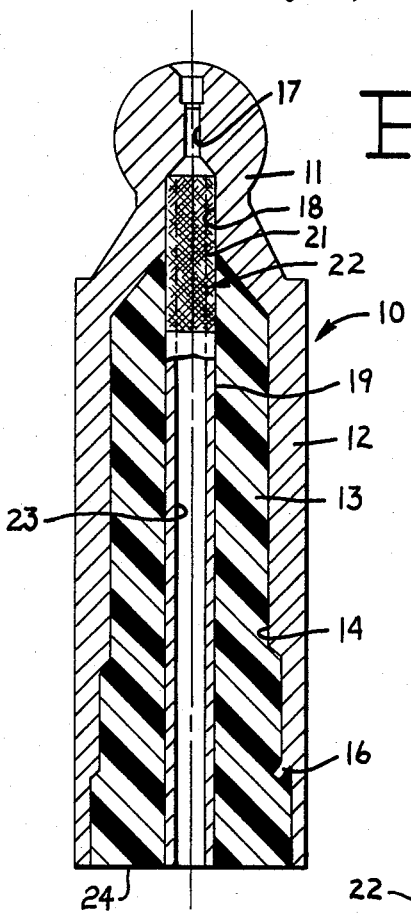
FIG. 1 is a cross sectional view of one embodiment of the present invention.

Referring now to FIG. 1, a piston is generally indicated by the reference numeral 10 and includes a base portion 11, a skirt portion 12, and a core 13 of lightweight filler material situated within a cavity 14 of the skirt portion 12. The core 13 of filler material is interlocked with the skirt portion 12 by a plurality of projections, one of which is shown at 16, extending inwardly into the cavity 14 sufficiently to engage and mechanically interlock the core. An orificed passage 17 and an axially aligned bore 18 are provided in the base portion 11.

A tube 19 extends axially through the core 13 of filler material and has an inner end portion 21 pressed into the bore 18 for connecting the tube 19 to the base portion 11. Preferrably the inner end portion 21 is knurled with a portion of the knurled inner end portion providing a means 22 for interlocking the tube 19 and the core 13 of filler material. A passage 23 in the tube communicates with the orificed passage 17 to provide a passageway through the piston 10 so that, in use, lubricating fluid passes through the piston to lubricate the bearing surfaces, not shown, normally associated with the piston. The core 13 of filler material has an outer end surface 24 free from contact with the skirt portion 12, the tube 19, and all other elements of the piston 10.

The core 13 of filler material normally comprises polymeric material such as an epoxy resin which is introduced into the cavity 14 in liquid form and cured therein to enclose the projections 16. In the present invention, the tube 19 is pressed into the bore 18 before the epoxy resin forming the core 13 is introduced into the cavity 14. Thus, the knurled end portion 21 of the tube initially serves as a controlled escape route for trapped and generated gases to bleed from the cavity 14 and through the orificed passage 17. Thereafter, as the epoxy resin cures, the core 13 is bonded to the knurled portion of the inner end portion 21 extending into the cavity to interlock the tube and the core of filler material.

Figure 2:
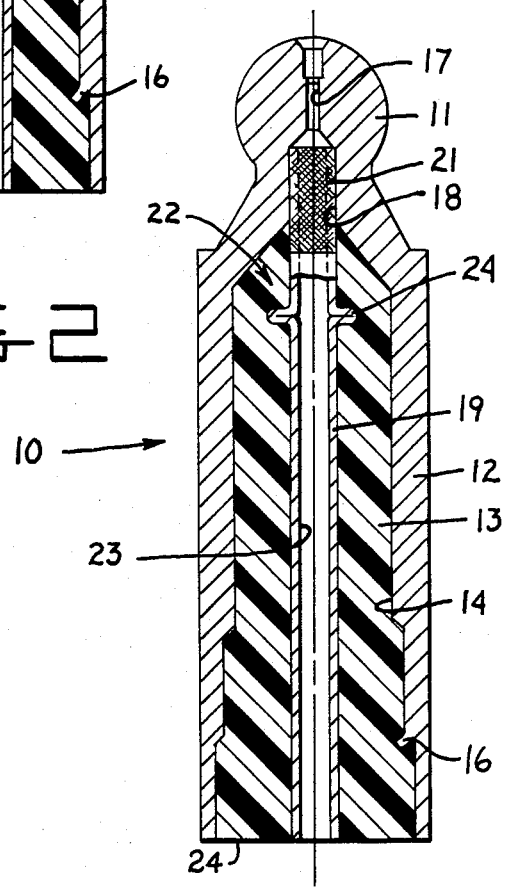
FIG. 2 is a cross sectional view of a second embodiment of the present invention.

Another embodiment of the piston 10 of the present invention is illustrated in FIG. 2. It is noted that the same reference numerals of the first embodiment are used to designate similarly constructed counterpart elements of this embodiment. In this embodiment, however, the means 22 for interlocking the tube 19 to the core 13 of filler material includes a flange or flanges 24 extending radially outwardly from the tube. Preferrably the tube 19 is metallic and the flange 24 is formed by an upset forging process. Moreover, preferrably the flange 24 is in close proximity to the base portion 11. Alternatively, the means 22 for interlocking can be an offset bend in the tube.

In view of the foregoing, it is readily apparent that the structure of the present invention provides an improved filled piston for use in a axial piston pump or motor. The piston has a tube extending through the core of filler material and forms a central passage through which the lubricating fluid passes through the piston to the bearing surfaces. The tube is an integral part of the piston and is restrained from movement. Thus, since the high pressure fluid passes through the passage in the tube rather than through a passage in the filler material, the formation of cracks and cavities in the filler material is no longer a problem.

Other aspects, objects, and advantages can be obtained from the drawings, the disclosure, and the appended claims.

We claim:

1. In a piston (10) having a base portion (11), a hollow open ended skirt portion (12), and a core (13) of lightweight filler material situated within the skirt portion (12), the improvement comprising:

a bore (18) formed in the base portion (11);

a tube (19) extending axially through the core (13) of filler material and having an inner end portion (21) extending into the bore (18) and including means for connecting said tube to the base portion (11);

means (22) for interlocking the tube (19) and the core (13) of filler material; and said core (13) of filler material having an outer end surface at the open end of said skirt free from contact with all other elements of the piston.

2. The piston (10) of claim 1 wherein said inner end portion (21) of said tube (19) is knurled and defines said connecting means.

3. The piston (10) of claim 2 wherein said means (22) for interlocking includes a portion of the knurled inner end portion (21).

4. The piston (10) of claim 1 wherein said means (22) for interlocking includes a flange (24) connected to and extending radially outwardly from the tube (19).

* * * * *